United States Patent [19]

Gaskell

[11] 4,139,953

[45] Feb. 20, 1979

[54] METHOD AND APPARATUS FOR DRYING PHOTOGRAPHIC STRIP MATERIAL

[75] Inventor: Alfred J. Gaskell, Hopkins, Minn.

[73] Assignee: PAKO Corporation, Minneapolis, Minn.

[21] Appl. No.: 779,070

[22] Filed: Mar. 18, 1977

[51] Int. Cl.[2] ..... F26B 3/04

[52] U.S. Cl. ..... 34/23; 34/31; 34/34; 34/159; 34/216; 34/46

[58] Field of Search ..... 219/388 R, 388C, 388 S, 219/388 W, 400; 34/46, 48, 50, 23, 31, 34, 155, 159, 160, 216, 225, 212

[56] References Cited

U.S. PATENT DOCUMENTS

| | | | |
|---|---|---|---|
| 1,339,374 | 5/1920 | Buensod | 34/46 |
| 1,523,509 | 1/1925 | Braemer | 34/46 |
| 1,534,499 | 4/1925 | Braemer | 34/50 |
| 1,907,220 | 5/1933 | Sibson et al. | 34/46 |
| 2,318,027 | 5/1943 | Sykes et al. | 34/46 |
| 2,370,422 | 2/1945 | Reed | 34/46 |
| 2,932,902 | 4/1960 | Copenhefer | 34/159 |

*Primary Examiner*—John J. Camby
*Assistant Examiner*—Larry I. Schwartz
*Attorney, Agent, or Firm*—John W. Adams

[57] ABSTRACT

A method and apparatus for drying photographic strip material utilizes a multiple chamber dryer having individual temperature and humidity control apparatus with a ducting system for delivering heated air from one chamber to another chamber as determined by the humidity control system.

18 Claims, 7 Drawing Figures

METHOD AND APPARATUS FOR DRYING PHOTOGRAPHIC STRIP MATERIAL

BACKGROUND OF THE INVENTION

The present invention relates to dryers for photographic materials. In particular, the present invention is an improved multichamber drying system and method.

PRIOR ART

In the past, dryers for photographic materials have controlled the temperature and humidity in each drying chamber individually. The chambers are not interconnected, but rather utilize separate venting to supply and exhaust air used in drying. This arrangement wastes energy, since each chamber must heat the air it uses. In many cases, air being exhausted from one chamber because its temperature is too low or its humidity is too high for use in that chamber may still have the proper temperature and humidity to be usable in another chamber.

SUMMARY OF THE INVENTION

The present invention is specifically designed to provide a plurality of interactive zone drying chambers which recirculate substantial portions of the drying air within each chamber but exhaust heated air to another chamber in accordance with the individual humidity control mechanism in each chamber. This interactive zone drying arrangement provides increased efficiency of energy use and permits optimum drying conditions to be easily maintained in each drying chamber.

DETAILED DESCRIPTION OF THE PREFERRED EMBODIMENTS

Figure 1:
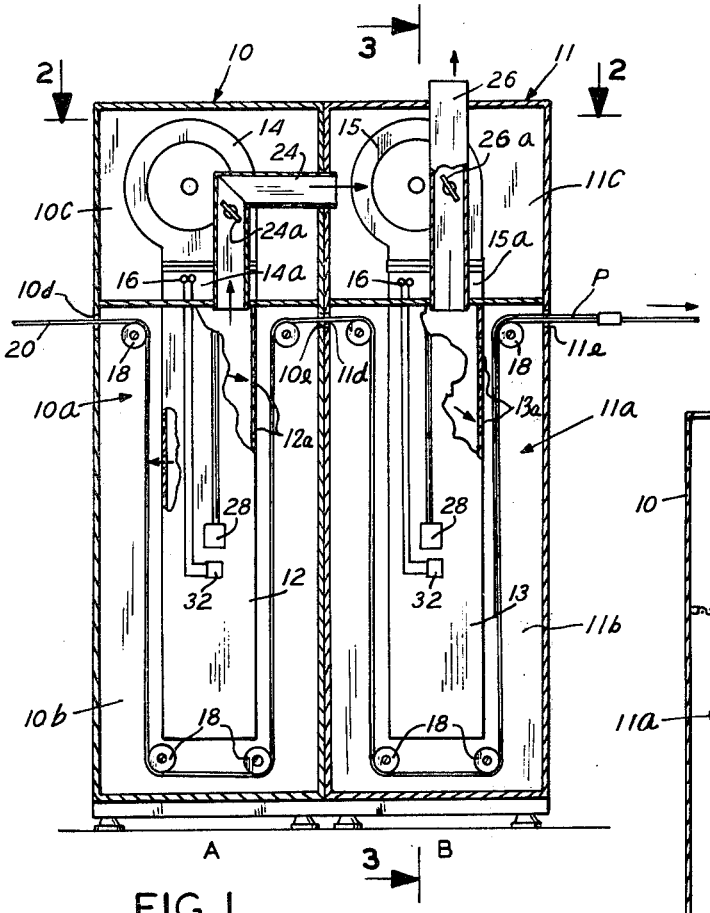
FIG. 1 is a vertical sectional view of a dryer embodying this invention and taken on the line 1—1 of FIG. 3.

A multiple chamber drying apparatus embodying this invention includes, in the form shown, a pair of dryer housings 10 and 11, each defining a drying chamber therewithin respectively designated by the reference characters **10*a* and 11*a*. Plenums 12 and 13 are respectively provided within said housings and divides the chambers 10*a* and 11*a* into high pressure zones respectively designated 10*b* and 11*b* and low pressure zones 10*c* and 11*c***.

Blowers 14 and 15 are provided for the respective drying chambers 10 and 11. The blower 14 has its air intake communicating with the low pressure zone **10*c* and its discharge outlet communicating directly with the upper portion of the plenum 12 and high pressure zone 10*b* defined therewithin. The blower 15 is similarly connected within drying chamber 11*a*. The plenums 12 and 13 have discharge openings such as slits 12*a* and 13*a* respectively formed in the sides thereof for discharging drying air from the high pressure zones 10*b* and 11*b* unto the low pressure zones 10*c* and 11*c***.

High pressure delivery ducts **14*a* and 15*a* respectively connect the blowers 14 and 15 to the upper ends of plenums 12 and 13, as illustrated, and are provided with heaters such as the electrical heating elements 16 for controlling the temperature of the high pressure air being delivered into the high pressure zones 10*b* and 11*b*. A conveyor system which includes a plurality of rollers 18 and belts 20, successively transports strips of photographic material such as photographic print paper P through the two drying chambers 10*a* and 11*a*. The belts and paper strips to be dried are conveyed into housing 10 through entrance opening 10*d* and out through exit opening 10*e* and into housing 11 through entrance opening 11*d* aligned with the exit opening 10*e* and out through its exit opening 11*e*** of the second drying chamber to carry the paper being dried successively from one chamber to the next.

An intercommunicating humidity control duct 24 is provided for connecting drying chamber **10*a* to drying chamber 11*a*. The intake end of duct 24 is positioned at the top of high pressure zone 10*b* in drying chamber 10*a* and the discharge end of duct 24 is positioned in the upper portion of the low pressure zone 11*c* in close association to the intake of blower 15. A humidity control duct 26 is provided in housing 11 and has its intake end located in the upper portion of the high pressure zone 11*b* and exhausts to the ambient air surrounding housing 11**, as best shown in FIG. 1.

The ducts 24 and 26 have flow control dampers **24*a* and 26*a* respectively mounted therein. The dampers are automatically controlled by a conventional humidity responsive system which includes a humidistat 28 with a conventional humidistat unit as described in U.S. Pat. No. 3,166,085 supplied by the Johnson Service Co., 507 East Michigan St., Milwaukee, Wis. 53201, part No. H-4100-203. The humidistat control embodies a pneumatic system which communicates with a suitable actuator such as a piston damper operator 30, part No. D 251-201 also manufactured by the Johnson Service Co. A suitable linkage, not shown, connects the operator piston to a crank arm which in turn opens and closes the damper elements 24*a* or 26*a*. The hot air from chamber 10*a* is ducted into the next successive chamber 11*a* thus reducing the heat energy required to maintain optimum temperature in the second chamber 11*a***.

A pair of thermostats 32 respectively mounted in the drying chambers **10*a* and 11*a* control the actuation of the two heater elements 16 to maintain the optimum temperature in each drying chamber. The two dryer housings 10 and 11** with their plenum and blower assemblies are of a modular construction to permit the drying capacity of the processor to be varied in accordance with each user's requirements and, of course, as the number of drying chambers is increased, the humidity control duct work is connected into other chambers in the manner herein disclosed and the final chamber is ducted to the ambient air as in the present disclosure.

It will be seen that this invention provides a system which is specifically designed to conserve and save energy thus resulting in cost savings for the user. Each housing provides a sealed chamber except for the first entrance opening and the last exit opening (in the form illustrated, entrance opening **10*d* and exit opening 11*e*). The relatively dry and cool ambient air will provide makeup air to replace the air exhausted through the high pressure duct 15*a* from the last chamber in the system; however, the system is otherwise a closed recirculating system which maintains maximum drying efficiency within the respective chambers 10a and 11a**. By providing the interconnection between successive drying chambers, it is possible to maintain the humidity in the first chamber somewhat lower (in the range of 15 to 23% rh) than would be possible with other systems, thus obtaining more efficient first stage drying at a somewhat lower temperature (in the range of 150° to 159° F.). An even lower temperature is possible in the second stage (between 110° and 120° F.) with approximately 50% relative humidity which is similar to the humidity in the ambient air. This prevents the paper from becoming excessively dry and which would produce excessive distortion and curling thereof.

The interactive zone dryer of the present invention, in which substantial portions of the drying are are recirculated from one chamber to another, not only assists in the humidity control of the different chambers but also provides preheated air for such chambers. This is particularly important where more than two chambers are assembled for successively drying photographic strip material.

Figure 2:
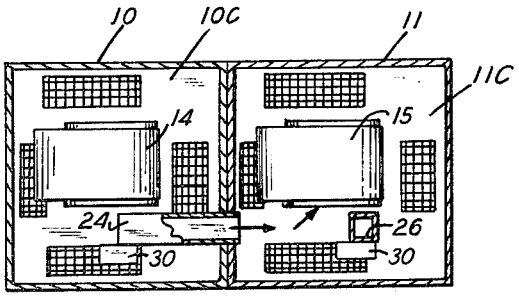
FIG. 2 is a horizontal sectional view thereof taken substantially along the line 2—2 of FIG. 1.
Figure 3:
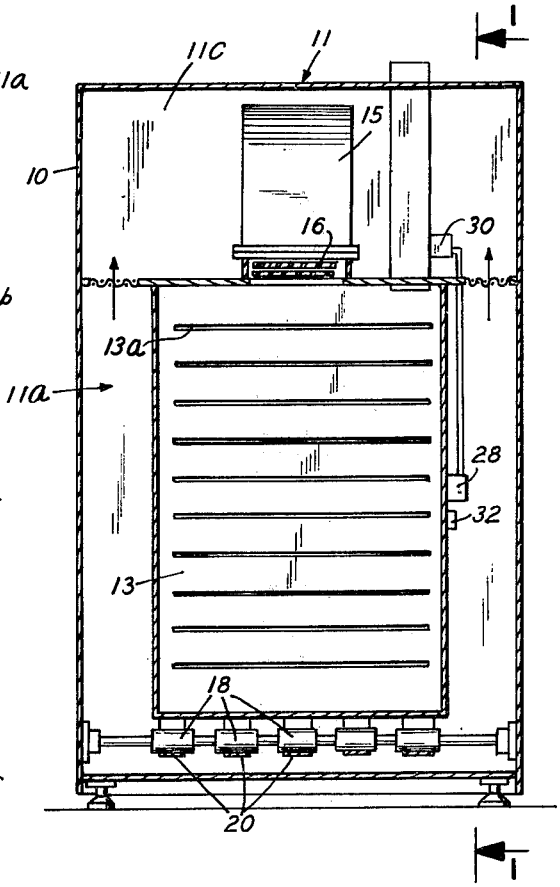
FIG. 3 is a vertical sectional view taken substantially along the line 3—3 of FIG. 1.

FIGS. 4 through 7 illustrate four possible configurations of a three chamber interactive zone dryer assembly in which the first chamber is designated by the letter A, the second chamber by the letter B and the third chamber in the succession by the letter C. For purposes of convenience, the numbers relating to chambers A and B shown FIGS. 1 through 3 will be carried forth into chambers A and B for FIGS. 4 through 7. The third drying chamber is designated by the letter C and includes a housing 35 having an entrance opening 35a and an exit opening 35b; a plenum 36 is provided therein and divides the chambers C into a high pressure zone 36b defined within the plenum 36 and a low pressure zone 36c.

A blower 37 draws air from the low pressure portion of the chamber and discharges the same into the plenum 36. An electrical heating element 16 is provided between the plenum and blower 36 and a plurality of rollers 18 define the necessary path for the belts 20 through the third chamber C. A humidity control duct 38 has its inner end connected to the high pressure zone 36b within the plenum 36 and in the arrangement illustrated in FIG. 4 exhausts air to the atmosphere. A damper 38a is provided in the duct to control the flow of exhaust air therethrough and a humidistat 28 and operator 30 are provided to automatically control the position of the damper. A thermostat 32 is provided to control the operation of the heating element 15 for chamber C.

Makeup air for chambers A and C is drawn in through the respective openings 10d and 35b respectively providing entrance and exit openings for the strip material for chambers A and C. The only source of makeup air for the central isolated chamber B is through the openings 11d and 11e respectively communicating with chambers A and C. For convenience, entrance and exit openings 10d, 10e, 11d, 11e, 35a and 35b, rollers 18, and belt 20 are shown only in FIG. 4. It should be understood, however, that the dryer assemblies shown in FIGS. 5 through 7 have similar openings, rollers, belt for conveying the prints through the assemblies.

Figure 4:
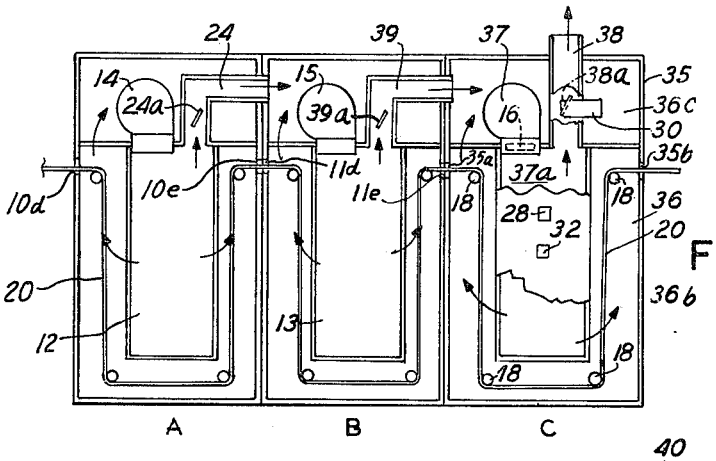
FIGS. 4–7 schematically illustrate four different possible interconnections of three drying chambers in accordance with the interactive zone drying of the present invention.

FIG. 4 illustrates the ducts conducting the air successively from chambers A and B to C respectively from the high pressure zone 10b to the low pressure zone 11c and from the high pressure zone 11b to the low pressure zone 36c of chamber C. The intercommunication duct between chambers B and C is designated by the numeral 39, having a control damper 39a therein, the position of which is controlled by the humidistat 28 and operator 30 located in chamber B.

Figure 5:
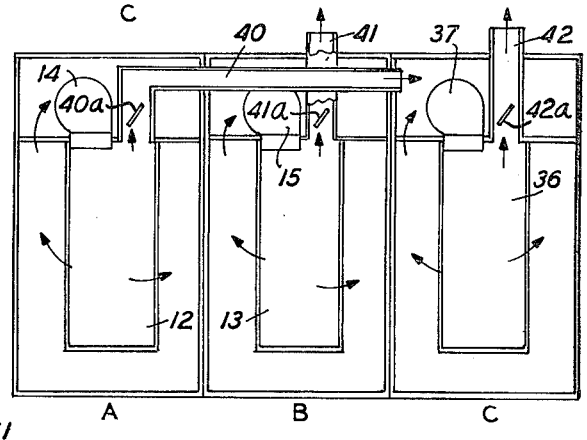

The arrangement of ducts in FIG. 5 shows the exhaust duct from chamber A extending into the low pressure zone of chamber C. This duct is designated by the numeral 40 and has a damper 40a therein which is responsive to the humidistat 28 and operator 30 located in chamber A. The humidity in chambers B and C is controlled by ducts 41 and 42 which are exhausted to the ambient air surrounding the dryer and suitable dampers 41a and 42a and provide for controlling the exhaust air respectively from chambers B and C in response to the humidity controls 28 and 30 located therein.

Figure 6:
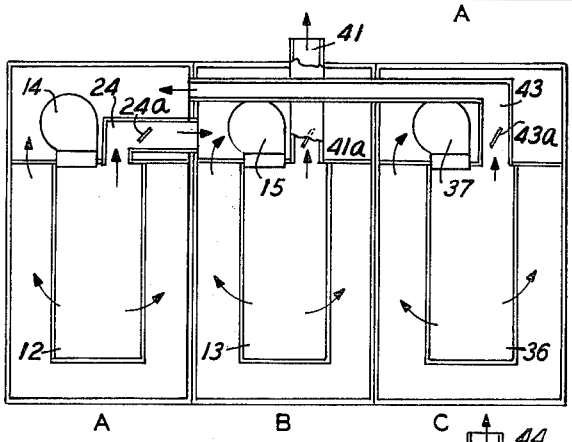

FIG. 6 shows the exhaust duct 43 from chamber C returning back to chamber A to supply makeup air thereto. The intercommunication duct 24 connects chambers A and B as previously described and chamber B is exhausted to the atmosphere through duct 41 similar to that shown in FIG. 5.

Figure 7:
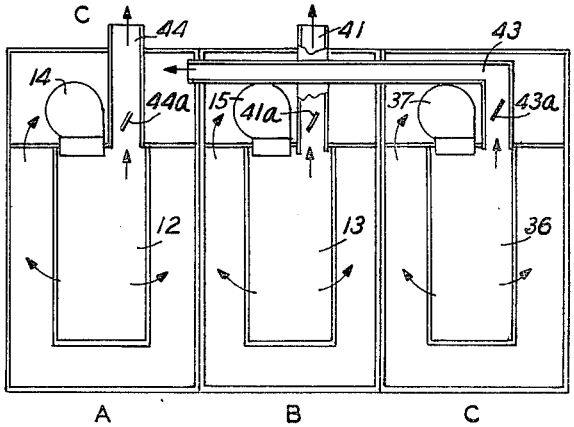

FIG. 7 shows an arrangement similar to FIG. 6 with the return duct 43 extending from chamber C back to chamber A. In FIG. 7, however, exhaust duct from chamber A exhausted to the atmosphere.

It will, of course, be understood that various changes may be made in the form, details, arrangement and proportions of the parts without departing from the scope of this invention, which generally stated is set forth in the appended claims. For example, although the interactive zone dryer of the present invention has been described with reference to two and three chamber assemblies, workers skilled in the art will recognize that the invention may also be used to great advantage with dryers having more than three chambers.

What is claimed is:

1. Apparatus for drying photographic strip material, the apparatus comprising:

a plurality of drying chambers at least certain of which are connected, the drying chambers being positioned successively to receive photographic strip material to be dried, each of the drying chambers having a high pressure zone and a low pressure zone;

blower means drawing air from the low pressure zones and discharging drying air into the high pressure zones;

conveyor means for conveying the photographic strip material successively through the high pressure zones of the drying chambers;

temperature control means for controlling the temperature of the air within the high pressure zones;

interchamber duct means connecting the high pressure zone of a first connected drying chamber to the low pressure zone of another drying chamber connected to said first chamber; and humidity control means in one of the connected drying chambers for controlling the flow of air through the interchamber duct means in accordance with the humidity of the air in the drying chamber being controlled.

2. The apparatus of claim 1 and further comprising:

a high pressure air supply plenum located in each drying chamber and having discharge openings positioned to direct air from the high pressure zone within the plenum against the photographic strip material being conveyed through the high pressure zone outside the plenum.

3. The apparatus of claim 2 and further comprising:
blower means in each drying chamber for receiving air from the low pressure zone and supplying air to the high pressure zone within the plenum.

4. The apparatus of claim 3 wherein the temperature control means comprises:
heater elements interposed between the blower means and the plenums; and
thermostatic control means in each drying chamber to control actuation of the heater elements and provide individual temperature control for each drying chamber.

5. The apparatus of claim 1 wherein the humidity control means comprises:
damper means positioned in the interchamber duct means; and
humidity responsive damper control means for controlling the damper means as a function of humidity of the air in one of the drying chambers.

6. The apparatus of claim 1 wherein the temperature control means maintains the first chamber of the plurality at the highest temperature and the last chamber of the plurality at the lowest temperature, and wherein the humidity control means maintains the first chamber at the lowest humidity and the last chamber at the highest humidity.

7. A method of drying photographic strip material comprising:
passing said strip material successively through a plurality of drying chambers certain of which are to be controlled;
maintaining the controlled drying chambers at different temperatures and humidity conditions;
recirculating portions of drying air within each drying chamber;
providing communication means between selected chambers;
exhausting other portions of the drying air to selected other chambers through said communication means; and
controlling the portions of air exhausted from one chamber to another in response to the humidity in the chambers to be controlled.

8. The method of claim 7 wherein exhausting portions of the drying air is through an interchamber communicating duct.

9. The method of claim 7 wherein exhausting portions of the drying air comprises:
sensing humidity within a drying chamber; and
controlling flow of drying air through the interchamber communicating duct as a function of the humidity sensed.

10. A method of drying photographic strip material in which the photographic strip material is passed successively through a plurality of drying chambers, the method comprising:
conditioning air by pressurizing and heating;
discharging the conditioned air into a first drying chamber through which the photographic strip material is transported;
measuring and controlling humidity in the first drying chamber; and
exhausting the conditioned air from the first drying chamber into a second drying chamber as a function of humidity in the first chamber; and
utilizing the air exhausted from the first drying chamber into the second drying chamber in drying of the photographic strip material in the second drying chamber.

11. The method of claim 10 wherein utilizing the air exhausted comprises:
heating the air exhausted into the second drying chamber; and
discharging the heated air into the second drying chamber through which the photographic strip material is transported.

12. Apparatus for drying photographic strip material, the apparatus comprising:
a drying chamber positioned to receive photographic strip material to be dried;
conveyor means for carrying the photographic strip material through the drying chamber;
a high pressure air supply plenum mounted in the drying chamber and having a plurality of discharge openings therein positioned to direct drying air outwardly from the plenum against the photographic strip material being conveyed, the plenum defining a high pressure zone within the plenum and a low pressure zone within the drying chamber and outside the plenum;
blower means receiving air from the low pressure zone and supplying air under pressure to the high pressure zone;
temperature control means for controlling the temperature of the air supplied by the blower means to the high pressure zone;
exhaust duct means connected to the high pressure zone; and
humidity control means for controllably restricting the flow of air through the exhaust duct means in accordance with the humidity of the air in the drying chamber to vary the quantity of outside air drawn into the low pressure zone and thereby control the humidity within the drying chamber.

13. The apparatus of claim 12 and further comprising:
a second drying chamber;
conveyor means for carrying the photographic strip material through the second drying chamber;
a second high pressure air supply plenum mounted in the second drying chamber and having a plurality of discharge openings therein position to direct drying air outwardly from the second plenum against the photographic strip material being conveyed, the second plenum defining a high pressure zone within the second plenum and a low pressure zone within the second drying chamber and outside the second plenum;
second blower means receiving air from the low pressure zone of the second drying chamber and supplying air under pressure to the high pressure zone of the second drying chamber;
second temperature control means for controlling the temperature of the air supplied by the second blower means to the high pressure zone; and
wherein the exhaust duct means is connected to the low pressure zone of the second drying chamber.

14. The apparatus of claim 13 wherein the humidity control means comprises:
damper means positioned in the exhaust duct means; and
humidity responsive damper control means for controlling the damper means as a function of humidity of the air in the drying chamber.

15. The apparatus of claim 14 wherein the humidity responsive damper control means senses humidity in the low pressure zone of the drying chamber.

16. The apparatus of claim 15 wherein the humidity responsive damper control means moves the damper means toward an open position as humidity in the low pressure zone of the drying chamber increases.

17. Apparatus for drying photographic strip material, the apparatus comprising:

a first drying chamber;

a second drying chamber, the first and second drying chambers being positioned successively to receive photographic strip material;

conveyor means for carrying the photographic strip material successively through the first and second drying chambers;

a high pressure air supply plenum located in each drying chamber and having discharge openings positioned to direct air from the plenum against the photographic strip material to be dried, the plenums dividing the drying chambers into a high pressure zone defined within each plenum and a low pressure zone within the drying chamber and outside the plenum;

blower means for receiving air from the low pressure zones and supplying air to the high pressure zones within the plenums;

temperature control means for controlling the temperature of the air discharged into each plenum;

duct means connecting the high pressure zone of the first drying chamber to the low pressure zone of the second drying chamber; and humidity control means for controlling the flow of air through the duct means in accordance with the humidity of the air in the first drying chamber.

18. The apparatus of claim 17 wherein the temperature control means comprises:

heater elements interposed between the blower means and the plenums; and thermostatic control means in each chamber to control actuation of the heater elements and provide individual temperature control for each drying chamber.

* * * * *